US007514643B1

(12) United States Patent
Tittle

(10) Patent No.: US 7,514,643 B1
(45) Date of Patent: Apr. 7, 2009

(54) LIGHTED PUSHBUTTON SWITCH ASSEMBLY

(75) Inventor: Michael D. Tittle, Harbor City, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 0 days.

(21) Appl. No.: 11/489,869

(22) Filed: Jul. 19, 2006

Related U.S. Application Data

(60) Provisional application No. 60/700,966, filed on Jul. 19, 2005.

(51) Int. Cl.
*H01H 9/00* (2006.01)

(52) U.S. Cl. ..... 200/314; 200/316

(58) Field of Classification Search ..... 200/314
See application file for complete search history.

(56) References Cited

U.S. PATENT DOCUMENTS

| | | | | |
|---|---|---|---|---|
| 3,204,067 | A | 8/1965 | Brown | |
| 3,523,168 | A * | 8/1970 | Holmes | 200/526 |
| 3,598,948 | A * | 8/1971 | Bowen et al. | 200/526 |
| 3,694,603 | A | 9/1972 | Congelliere et al. | |
| 3,801,753 | A | 4/1974 | Szymber | |
| 4,175,222 | A | 11/1979 | Buttner | |
| 4,506,124 | A | 3/1985 | Rose et al. | |
| 4,885,443 | A | 12/1989 | Simcoe et al. | |
| 4,891,476 | A | 1/1990 | Nation et al. | |
| 4,906,808 | A | 3/1990 | Burgess et al. | |
| 5,043,546 | A | 8/1991 | Krause | |
| 5,194,703 | A | 3/1993 | Deeg | |
| 5,201,408 | A | 4/1993 | Torma et al. | |
| 5,226,529 | A | 7/1993 | Valenzona | |
| 5,268,542 | A | 12/1993 | Voll | |
| 5,285,037 | A | 2/1994 | Baranski et al. | |
| 5,442,150 | A | 8/1995 | Ipcinski | |
| 5,620,086 | A | 4/1997 | Bianca et al. | |
| 5,636,729 | A | 6/1997 | Wiciel | |
| 6,180,905 | B1 * | 1/2001 | Pollock et al. | 200/527 |
| 6,737,596 | B1 * | 5/2004 | Hein | 200/310 |
| 6,743,993 | B1 * | 6/2004 | Clark et al. | 200/314 |

* cited by examiner

*Primary Examiner*—Elvin G Enad
*Assistant Examiner*—Lheiren Mae A Anglo
(74) *Attorney, Agent, or Firm*—Michael Zarrabian, Esq.; Myers Andras Sherman LLP

(57) ABSTRACT

A lighted pushbutton switch assembly has a printed circuit board in the bottom of a housing, with an LED mounted on the board. A switch operating plunger at the top rotates a ratchet and electrical contact member whenever the plunger is depressed. The contact member engages conductive paths on the top of the PC board and moves from path to path as it is rotated to change the state of the switch. A transparent light pipe over the LED transmits light through the plunger. The light pipe fits through the ratchet and is rotated by the ratchet to rotate the electrical contact member.

18 Claims, 10 Drawing Sheets

LIGHTED PUSHBUTTON SWITCH ASSEMBLY

CROSS REFERENCE TO RELATED APPLICATION

This application claims benefit of the filing date of U.S. Patent Application 60/700,966, Filed Jul. 19, 2005, the subject matter of which is hereby incorporated by reference.

FIELD OF THE INVENTION

This invention concerns a lighted pushbutton switch such as may be used in an automobile, for example.

BACKGROUND

It may be desirable to have a light on or within a switch so that it can be found in the dark or quickly found in low lighting. Such lighting of a switch operator is well known in household toggle switches, for example. Internal lighting is particularly desirable for use in an automobile where cockpit lighting is normally quite low for night driving. Pushbutton switches are commonly used in automobiles for ON-OFF switching or for toggling between alternative applications. Thus, a lighted pushbutton switch is desirable.

BRIEF SUMMARY OF THE INVENTION

An illuminated pushbutton switch assembly described and illustrated in an embodiment of this invention has a light emitting diode on a printed circuit board mounted in the body of the switch. The switch operating mechanism is partly conventional but includes a hollow or transparent plunger for operating the mechanism. The light emitting diode illuminates a light pipe which casts a light through the plunger of the switch.

DRAWINGS

DESCRIPTION

Figure 1:
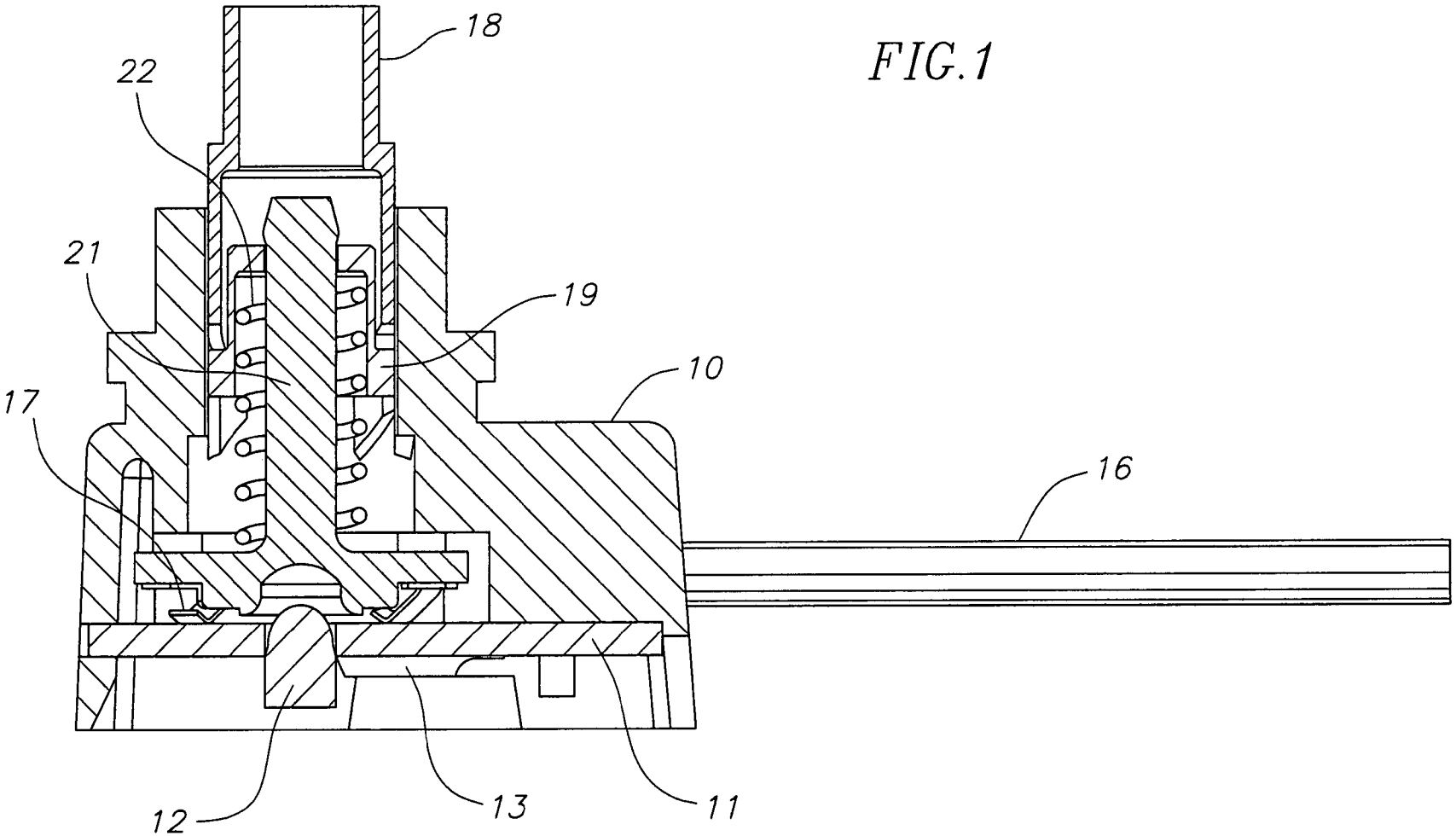
FIG. 1 is a transverse cross-section through an exemplary illuminated pushbutton switch constructed according to principles of this invention.
Figure 2:
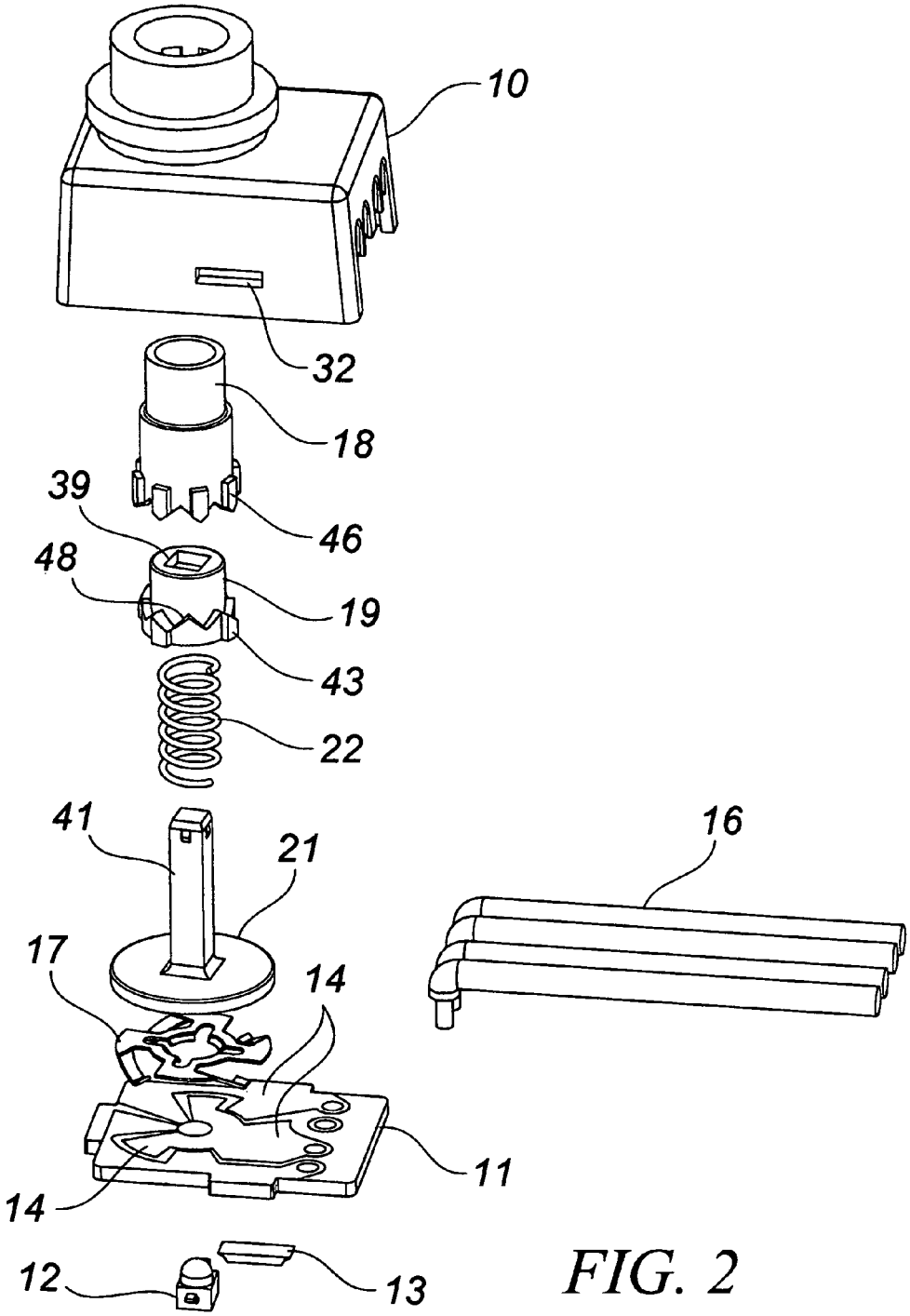
FIG. 2 is an exploded view illustrating the individual parts of the switch assembly.

The parts comprising an exemplary lighted pushbutton switch assembly are illustrated in FIGS. 1 and 2. The assembly is housed in an injection molded plastic body 10. The body is open at the bottom and is closed by the printed circuit board 11 (PC board) mounted in the bottom of the body. A light emitting diode (LED) 12, and surface mounted resistor 13 are mounted on the bottom of the PC board. Electrically conductive paths 14 on the top face of the PC board, are connected to electrical wires 16 which extend laterally from the PC board to the outside of the switch body. A rotatable electrical contact member 17 closes connections between the conductive paths on the PC board in selected rotational positions.

A hollow plunger 18 extends through the top of the housing for operating the switch. When depressed, the plunger engages and rotates a ratchet 19 which, in turn, rotates a contact support and light pipe 21. A ratchet spring 22 biases the ratchet and plunger outwardly.

Some of the individual parts of the switch assembly are separately illustrated and described hereinafter. Designation of parts of the switch as top and bottom, for example, is simply a matter of convenience for description. The switch can be operated in any position. For example, it might be mounted where the "bottom" faces upwardly or sideways in an automobile.

Broadly, the state of the switch is changed by depressing the plunger of the switch assembly, which presses the ratchet downwardly. The ratchet rotates part way as it goes down and another part way as it goes up, causing rotation of the contact support and light pipe 21, and electrical contact member 17, thereby moving the contact member across the conductive paths on the PC board. The light emitting diode (LED) on the PC board sends light through the light pipe and the hollow switch-operating plunger so that the location of the switch can be seen in the dark. Low level lighting in the switch is adequate and is independent of functioning of the switch.

Figure 3:
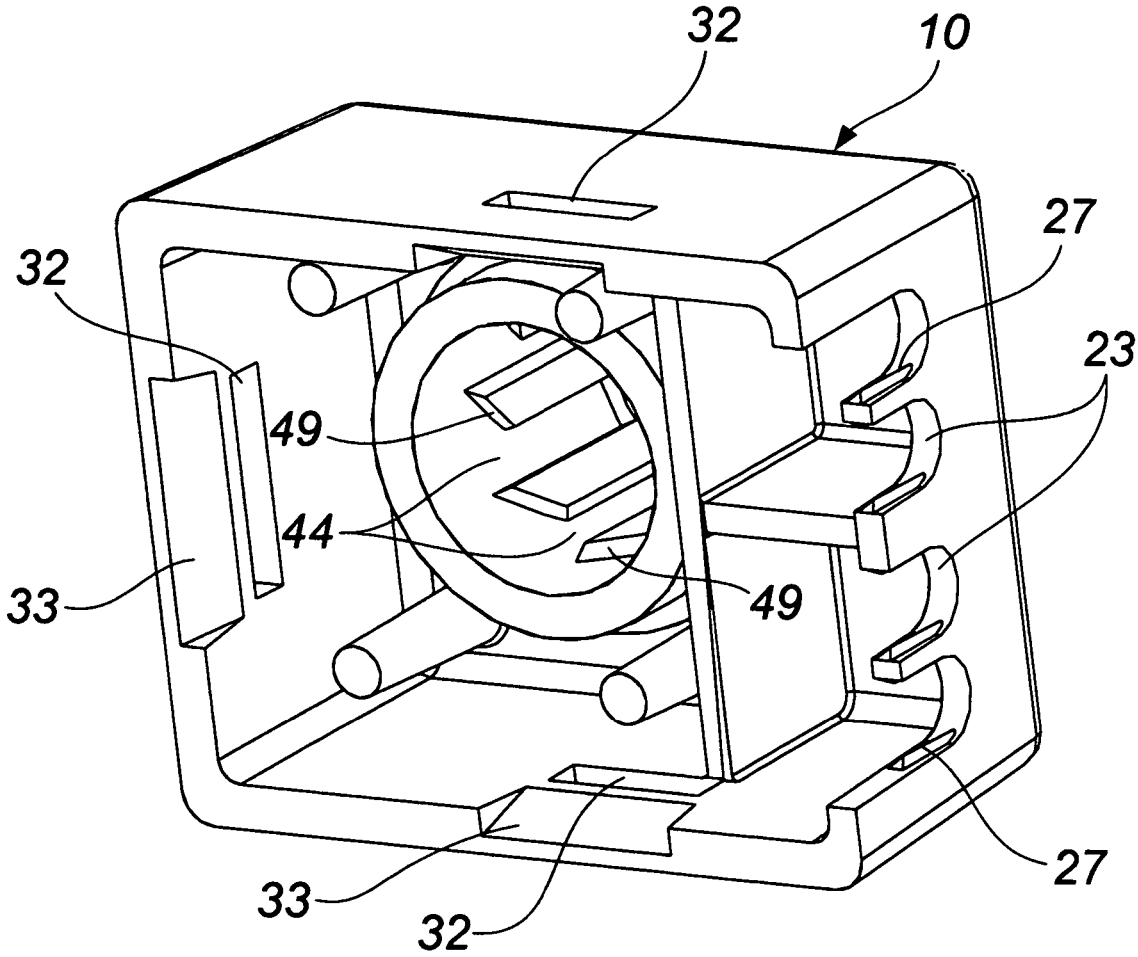
FIG. 3 is a bottom view of the body or housing of the switch assembly.

FIG. 3 illustrates the inside of the body or housing of the switch as seen from what is considered to be the bottom of the switch for purposes of this description. The right side of the body as illustrated in the cross section of FIG. 1 appears to be solid, however, it will be noted from the view of the underside illustrated in FIG. 3 that the apparent solid portion is simply because the cross-section is taken through a web between the slots 23 through which external connection wires are brought into the housing.

The external lead wires 16 extend through plated-though holes 24 in the PC board. Three of these wires make electrical contact with conductive paths 14 on the top face of the PC board. Two of the wires make electrical contact with conductive paths 26 on the bottom face of the PC board. (In this embodiment one of the four wires provides electrical power to paths on both the top and bottom faces.) When the PC board with attached wires is pressed into the bottom of the switch assembly housing, small ridges 27 on the sides of the slots slice slightly into the insulation on the wires to help hold them in place.

Figure 4:
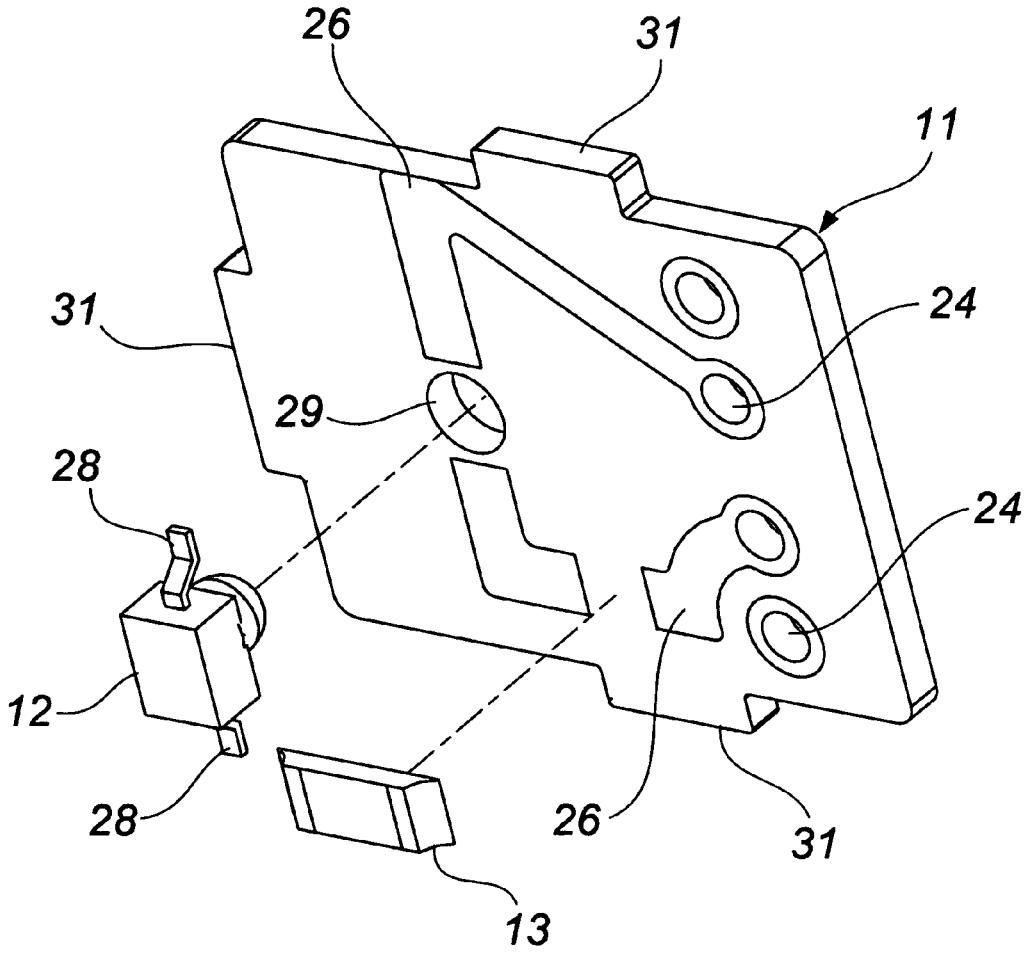
FIG. 4 is a view of the bottom of a printed circuit board used in the assembly, with a light emitting diode and resistor exploded from the surface of the PC board.
Figure 5:
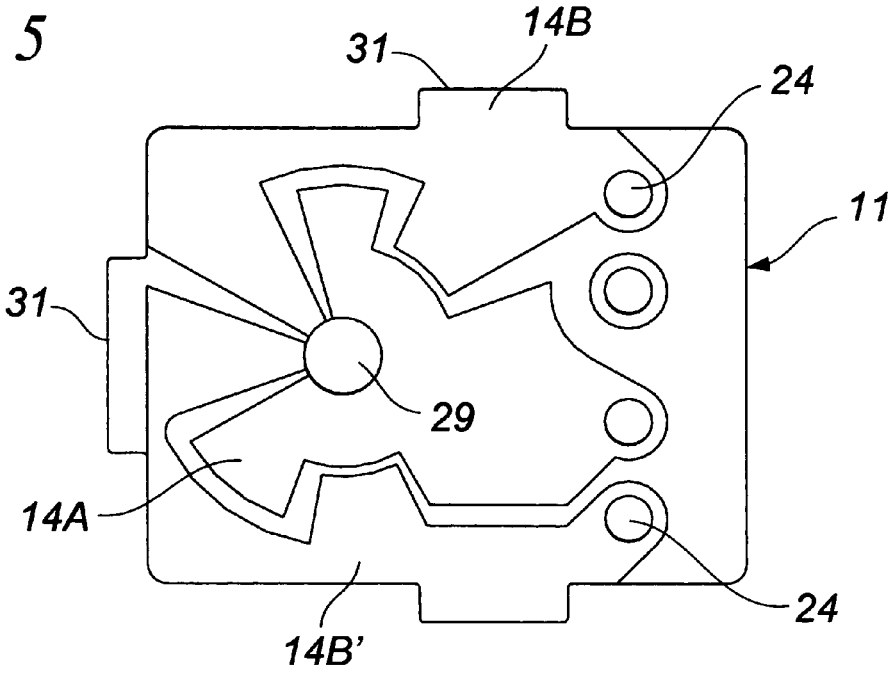
FIG. 5 illustrates the top face of the PC board including electrical contact areas.

The LED is surface mounted on the back face of the PC board, as indicated where it is exploded from the board in FIG. 4. The LED leads 28 are soldered to conductive paths on the bottom face of the board and the LED extends into a hole 29 through the board. The surface mounted resistor 13 for the LED is soldered to electrical leads on the bottom of the board in series with the LED. Thus, current can be applied continually to the LED via the center two of the external wires. Although there are great advantages to using an LED, it will be understood that other light emitting devices, such as an incandescent bulb, may be used to light the switch.

The PC board has three outwardly extending tabs 31 in the plane of the board along the three edges away from the region where external electrical connection wires attach. These three tabs snap into slots 32 in three sides of the body when the switch is assembled, effectively closing the bottom of the switch. It can be seen in FIG. 3 that there are tapered ramps 33 adjacent each of the slots in the sides of the body so that the tabs slightly deflect the sides of the body as the PC board is inserted into the open bottom of the housing or body. The sides snap back and encompass the tabs on the PC board to hold it in place.

Figure 6:
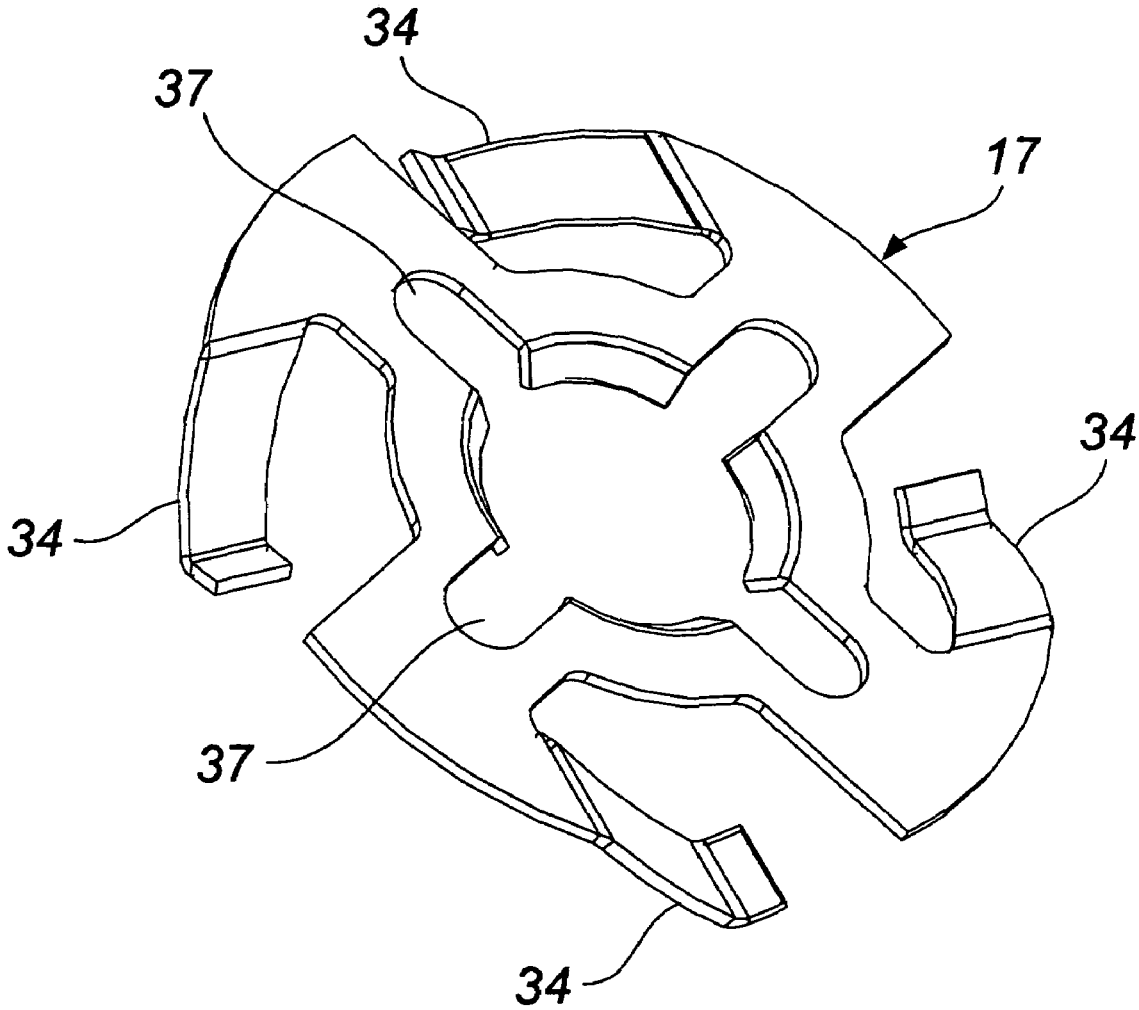
FIGS. 6 and 7 are perspective and side views, respectively, of a rotating electrical contact, the legs of which engage the top face of the PC board.
Figure 7:
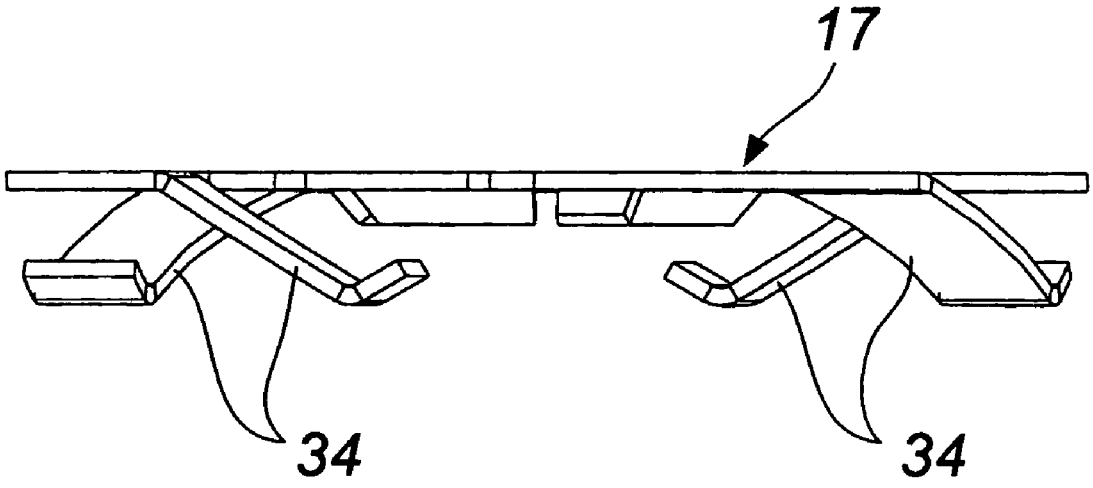

FIGS. 6 and 7 are perspective and side views respectively of the rotating contact 17, which is made of a hard electrically conductive alloy such as beryllium-copper. Four circumferentially extending legs 34 extend downwardly from the principal portion of the rotating contact. The ends of these legs make electrical contact with the conductive areas on the upper face of the printed circuit board. The specific embodiment of switch illustrated causes the contact to rotate 45° (always in the same direction) whenever the plunger is depressed. (Actually, part of the ratchet rotation occurs when the plunger is depressed, and the other part occurs when the plunger is released and returns toward its outward position, but for convenience, this combined motion is sometimes referred to herein simply as depression.)

Thus, as described further hereinafter, upon each depression of the plunger the switch transitions between a first ON state and a second ON state. This is just one example of a pattern that might be provided on a PC board and one might easily provide for an ON-OFF function, for example. Such a switch may also be made with angles of rotation different from 45°.

In the embodiment illustrated, the pattern of conductive areas on the upper face of the PC board is such that opposite legs on the rotating contact are alternately in contact with the central conductive area 14A and one of the peripheral conductive areas 14B on the upper face of the PC board. This arrangement on the PC board provides redundant electrical contacts for reliability.

Figure 11:
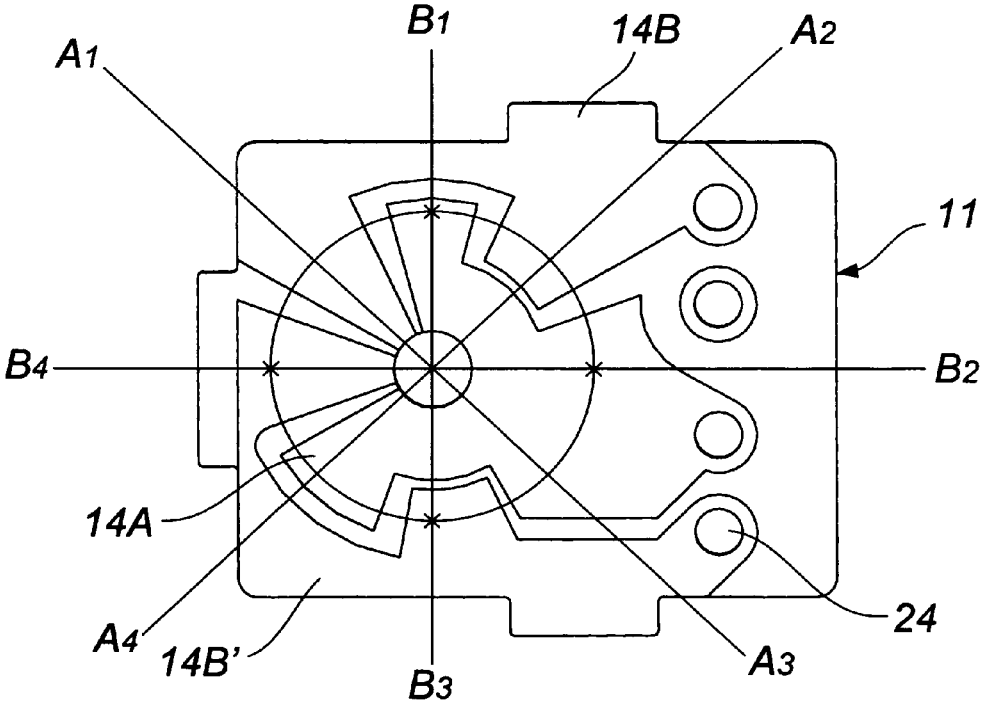
FIG. 11 is another top view of the PC board similar to FIG. 5 with lines added to illustrate switch operation.

In a given rotational position (A) of the switch, legs on the rotatable contact member are in positions where the A lines intersect the circle illustrated in FIG. 11. When in this position, legs A1 and A2 are in contact with one outer conductive path 14B area and the other legs A3 and A4 are in contact with the more central conductive path 14A. Thus, there is a closed electrical circuit between this outer paths and the central path and the switch is in one ON state. The contacts A1 and A2 are redundant and assure reliable contact with the outer area. Likewise, the contacts A3 and A4 are redundant to assure reliable contact.

When the switch is rotated 45° to the B position, two legs B3 and B4 are in electrical contact with the other outer conductive path (labeled as 14B') and legs B1 and B2 are in redundant contact with the central area 14A. Thus, the switch is in the other ON state. This "wiring" is appropriate for a switch for toggling between two ON states. One of the outer conductive paths could be omitted (or an external lead wire omitted) to make an ON-OFF switch. Other patterns of conductive paths will also be apparent.

Figure 8:
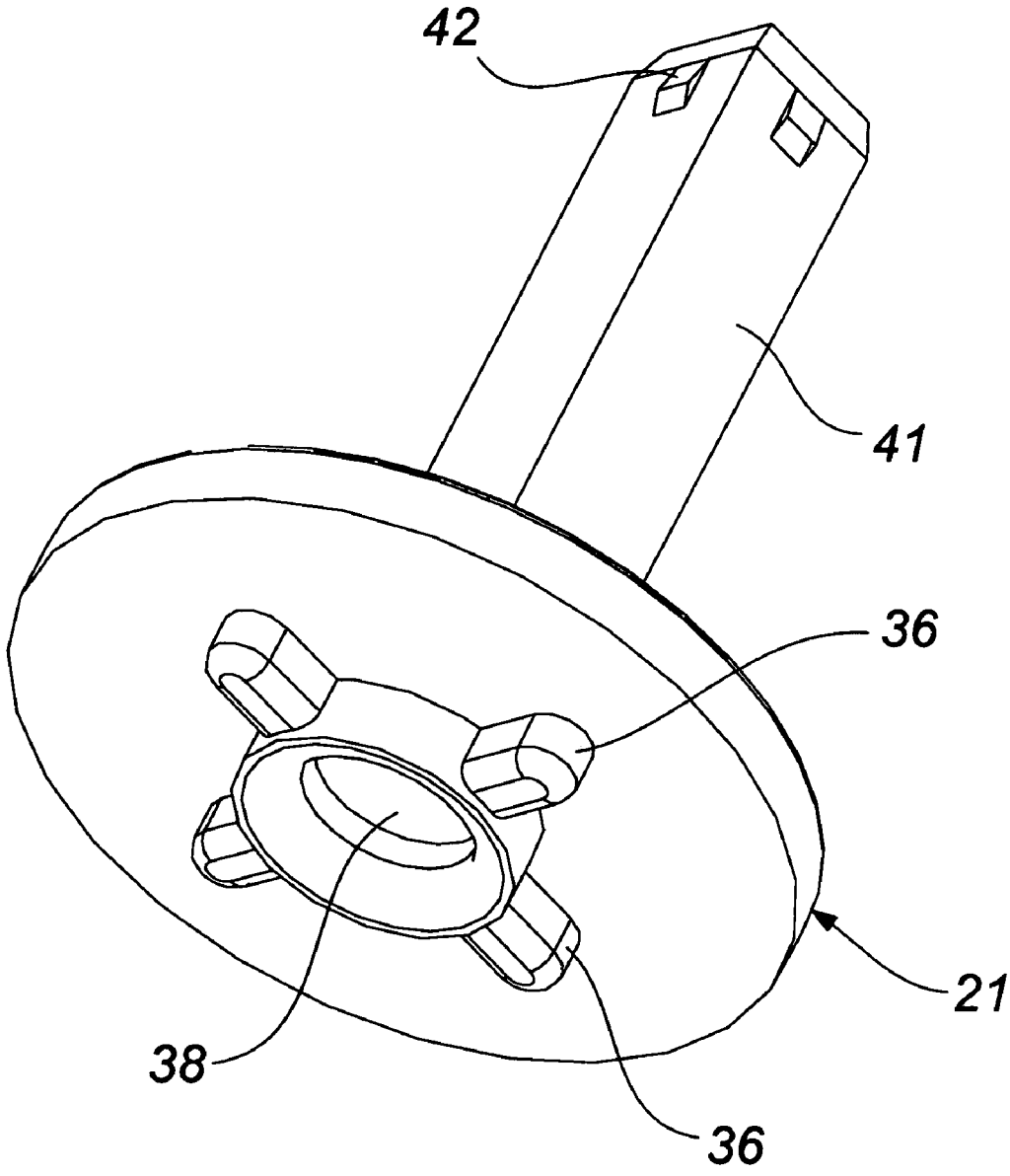
FIG. 8 illustrates in perspective a transparent light pipe.
Figure 10:
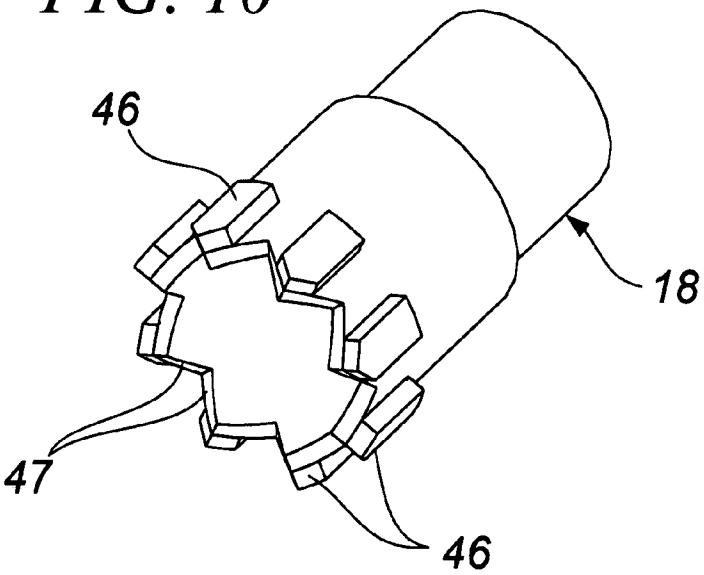
FIGS. 9 and 10 illustrate a ratchet and plunger, respectively, which include dogs or teeth for the operating mechanism of the pushbutton switch.
Figure 9:
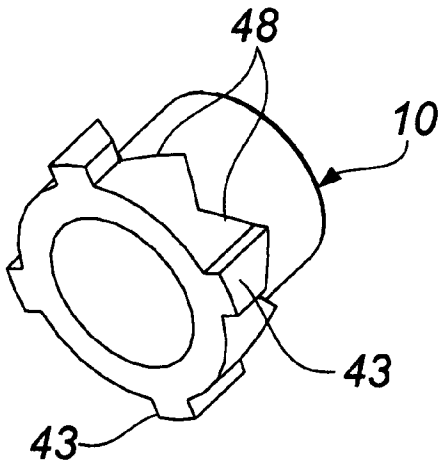

FIG. 8 is a bottom perspective view of the contact support and light pipe. A bottom flat end of the contact support has four radiating ribs 36 which fit into four corresponding radiating openings 37 in the central part of the rotating contact member (FIG. 6). Thus, rotation of the contact support rotates the rotating contact.

The central portion of the contact support and light pipe has a pocket 38 which overlies the LED when the switch is assembled. The top of the pocket is concave to act somewhat as a concave lens gathering light from the LED. The contact support and light pipe are made of a transparent plastic so that light from the LED is concentrated and conveyed along the stem of the light pipe to radiate through the hollow plunger.

In this embodiment, the plunger in the switch assembly is hollow for transmitting light, hence is transparent even if made of opaque material. This is suitable since the specific switch is located behind a transparent cover in its intended application. If desired the plunger may have a transparent plug or be made of transparent material with a closed end.

The ratchet 19 includes a square central hole 39 (FIG. 1) which fits around the square extending shaft 41 of the contact support and light pipe. Slight raised detents 42 near the upper end of the light pipe shaft snap through the square opening through the ratchet and retain the ratchet on the contact support when the switch is assembled. The ratchet is free to slide along the length of the light pipe below the detents. The ratchet hole and shaft need not be square, and may be other non-round shape so that the ratchet and light pipe rotate together.

There are eight radially extending dogs 46 around the lower end of the plunger 18. A circumferentially extending, downwardly facing band of eight angled teeth 47 on the plunger engages a complementary band of angled teeth 48 facing upwardly on the ratchet. The ratchet includes four radiating dogs 43 near the upper end which fit into grooves 44 within the central opening of the switch body (FIG. 3). The angled top faces on the dogs on the ratchet engage downwardly facing angled faces 49 on ribs within the central opening in the top of the housing when the ratchet moves upwardly. These engaging faces cam the ratchet to rotate when the plunger is released, thereby rotating not only the ratchet but also the contact support and light pipe, and the electrical contact member 17 to change the state of the switch.

The grooves and ribs in the body engaging the dogs 46 on the plunger prevent rotation of the plunger. Non-alignment of the teeth on the plunger and ratchet cause partial rotation of the ratchet when the dogs on the ratchet move out of the grooves in the body. The rest of the rotation to a new angular position occurs when the plunger is released and the angled faces on the ratchet engage the angled faces in the body.

Such a combination of plunger, ratchet, dogs, grooves, teeth, angled faces, etc., is partly conventional for causing rotational advancement upon pressing the plunger of a push-button switch. Somewhat similar switch operating mechanisms are shown, for example, in U.S. Pat. Nos. 4,175,222 and 5,226,529.

The specific arrangement and number of teeth, dogs grooves, ribs, etc., described herein causes the ratchet, contact support and rotating contact to rotate 45° each time the plunger is depressed. If desired one may change the number of teeth and dogs on the parts so that the switch has twelve rotational positions instead of eight for the illustrated switch. Then it is easy to have three functions such as $ON_1$-$ON_2$-OFF or four functions such as $ON_1$-OFF-$ON_2$-OFF. Other variations in numbers of teeth, switch positions, numbers of functions and patterns of conductive areas on a PC board will be apparent to those skilled in the art.

The ratchet spring 22 around the shaft of the contact support and light pipe, and inside the lower end of the ratchet, restores the ratchet and plunger toward their extended or outward position when pressure on the plunger is released. The spring also biases the light pipe and hence the electrical contact member toward the upper face of the PC board for good electrical contact.

As illustrated in this embodiment, the bottom of the switch body is open below the PC board. If desired to protect or insulate the otherwise exposed components mounted on the bottom of the PC board, one may encase them in potting material. One could also mount a cover over the bottom, such as, for example a simple sheet with tabs that snap around the outside of the switch body or slip into slots (not shown in the drawings) on the inside of the body to hold the cover in place. Suitable grooves or slots can be made with the same mold slides that form the slots into which the PC board snaps.

Figure 12:
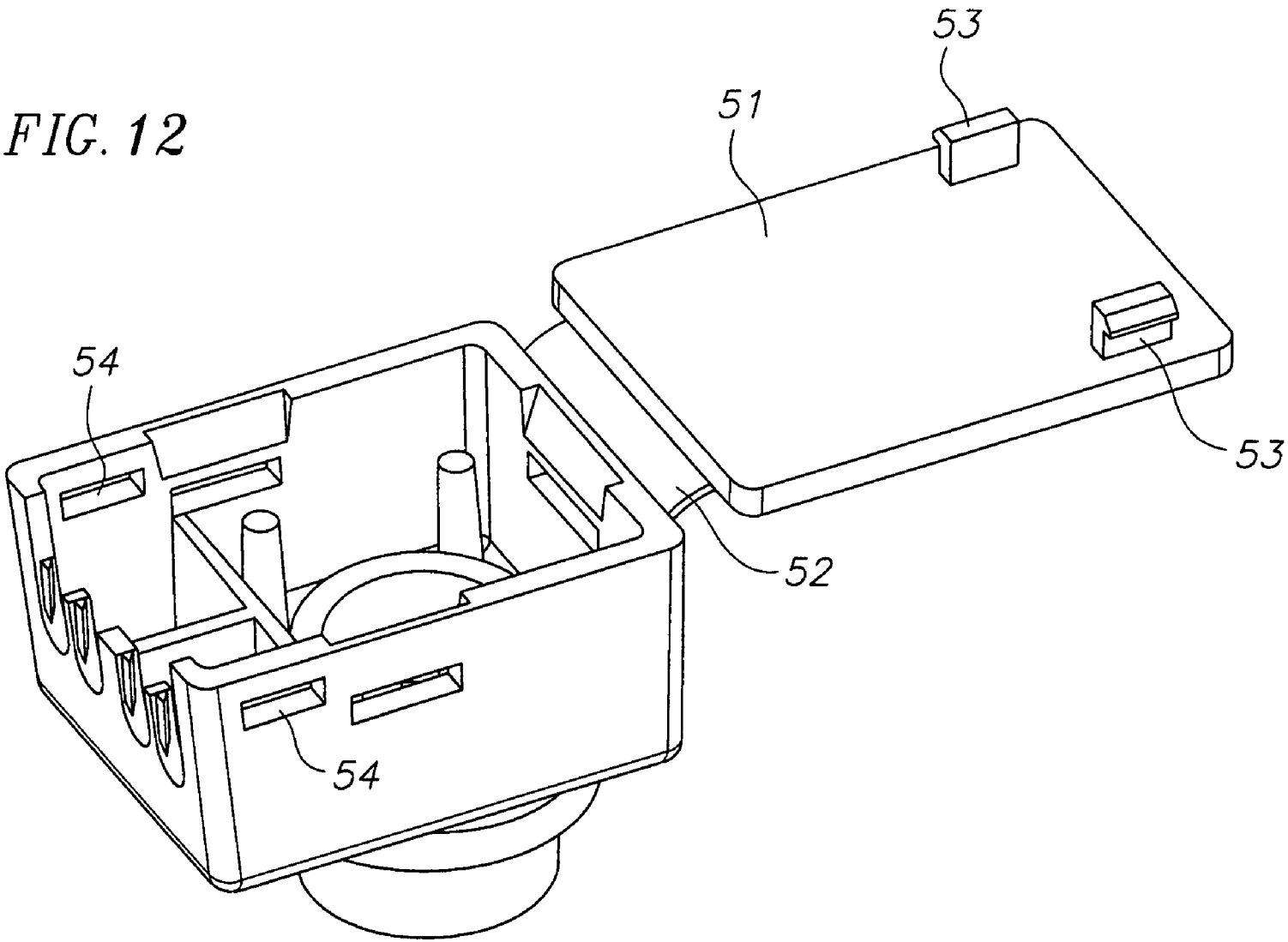
FIG. 12 is a bottom perspective view of an alternative embodiment of the body for a switch assembly.

Another way of closing the bottom of the housing or body of the switch assembly is illustrated in FIG. 12. In this embodiment, a switch housing similar to the housing already illustrated has a bottom cover 51 formed integral with the housing. The cover is formed in the same mold as the body and is connected by a thin web 52 of plastic usually referred to as a "living hinge." As illustrated, the cover is molded essentially parallel to and beside the body. After the other components of the switch are assembled, the cover is rotated around the living hinge and tabs 53 on the cover snap into slots 54 through the walls of the body. This closes the bottom with the cover spaced apart from the PC board.

Another arrangement for the switch employs what amounts to a three dimensional PC board snapped into the bottom of the housing so that components are all mounted on one face of the board and the opposite face forms the bottom of the switch. I.e., the PC board is the bottom cover.

Such an integral PC board and cover (sometimes referred to as a molded interconnect device or MID) can be formed by laser direct structuring. The desired part is formed by conventional injection molding to any desired shape using a special photosensitive plastic. The plastic incorporates metal complex molecules. A laser is then used to "draw" a circuit onto the surface of the part. When the metal complex is exposed to (usually infrared) laser light, the metal complex is broken into an elementary metal such as copper and residual organic groups. The part is then electrolessly plated with copper, nickel and/or other desired conductor. The conductors are formed along the paths exposed to the laser light and the remainder of the bulk and surface plastic remains non-conductive. A broad variety of plastic substrates are suitable for the laser direct structuring process.

Additional information about, and materials and equipment suitable for laser direct structuring can be obtained from LPKF of Wilsonville, Oreg., and BASF Aktiengesselfschaft of Ludwigshafen, Germany.

Such an integral PC board and cover can be used for the bottom of the switch. A part is molded with cavities on the top face suitable for the resistor and the LED which illuminates the switch. Conductive traces are formed on the top surface, including traces extending into the cavities. The LED and resistor are soldered to the traces, and the integral part is ready for assembly into the switch housing. It can be snapped into the body just like the PC board described and illustrated herein.

An exemplary use for such a switch as described and illustrated herein can be behind a transparent pushbutton plate in an automobile. Light from the LED mounted on the PC board shines through the light pipe and hollow plunger to put a small colored light on the pushbutton switch plate so that the switch plate can be found in the dark. The LED in such a switch may be left ON all of the time, i.e., independent of switch function, or may be connected so as to be ON only when the switch function is OFF.

What is claimed is:

1. A lighted switch assembly having a light emitting device on a PC board snapped into a housing of the switch assembly and illuminating a light pipe that casts a light through a plunger of the switch assembly, wherein the light through the plunger is capable of illuminating a pushbutton, the switch assembly including electrically conductive paths on the PC board, a rotatable electrically conductive member to engage the conductive paths, and means between the plunger and the conductive member for rotating the electrically conductive member in response to depression of the plunger, wherein the light pipe connects the means for rotating and the electrically conductive member.

2. A lighted switch according to claim 1, wherein the light pipe is substantially concentric with the rotation.

3. A lighted switch according to claim 1, wherein the light emitting device, the light pipe and the plunger are arranged in a column.

4. A lighted switch assembly, comprising:

a switch body;

a printed circuit board in a bottom portion of the switch body;

a light emitting device on the printed circuit board;

electrically conductive paths on the printed circuit board;

an electrical contact member that engages the electrically conductive paths;

a pushbutton switch operating mechanism connected to the electrical contact member, the pushbutton switch operating mechanism including a plunger for transmitting light through the switch operating mechanism;

a transparent light pipe between the light emitting device and the plunger shaped to collect light from the light emitting device and to radiate the collected light to the plunger, wherein the plunger engages means for rotating the electrical contact member and the light through the plunger is capable of illuminating a pushbutton; and a rotatable ratchet directly engaging the plunger, wherein the light pipe engages the ratchet for rotation.

5. A lighted switch according to claim 4, wherein the electrical contact member engages the electrically conductive paths by rotation, the light emitting device is essentially concentric with the plunger and wherein the rotation is substantially concentric with a path of the light transmitting through the switch operating mechanism.

6. A lighted switch according to claim 4, wherein the electrical contact member engages the electrically conductive paths by rotation, the transparent light pipe including a concave portion adjacent the light emitting device and a non-round shaft at the opposite side from the concave portion, such that the shaft is essentially concentric with the rotation.

7. A lighted switch according to claim 6, wherein the plunger is hollow, and wherein the light pipe enters at least an end of the plunger.

8. A lighted switch according to claim 4, further comprising a tab on the printed circuit board, and a recess in the switch body fitting around the tab.

9. A lighted switch according to claim 4, further comprising a transparent light pipe between the light emitting device and the plunger shaped to collect light from the light emitting device and to radiate the collected light to the plunger, wherein the light emitting device, the light pipe and the plunger are essentially concentric, and wherein the light emitting device comprises a light emitting diode surface mounted on the printed circuit board.

10. A lighted switch according to claim 4, wherein the electrical contact member comprises a rotatable electrically conductive member engaging at least some conductive paths on a top face of the printed circuit board; and wherein the light emitting device is electrically connected to conductive paths on a bottom face of the printed circuit board.

11. A lighted switch assembly, comprising:

a switch body;

a light emitting device in a bottom portion of the body on a printed circuit board snapped into the body of the switch assembly and illuminating a light pipe that casts a light through a plunger of the switch assembly, wherein the light through the plunger is capable of illuminating a pushbutton;

a pushbutton switch operating mechanism, the pushbutton switch operating mechanism including said plunger for transmitting light through the switch operating mechanism; and the light pipe transmitting light between the light emitting device and the plunger, wherein the light pipe, the plunger and the light emitting device are essentially concentric;

the switch assembly including electrically conductive paths on the printed circuit board, a rotatable electrically conductive member to engage the conductive paths, and means between the plunger and the conductive member for rotating the electrically conductive member in response to depression of the plunger, wherein the light pipe connects the means for rotating and the electrically conductive member.

12. A lighted switch according to claim 11, wherein the plunger is hollow.

13. A lighted switch according to claim 11, wherein the light pipe includes a concave portion adjacent the light emitting device, and a non-round portion adjacent the plunger.

14. A lighted switch according to claim 11, wherein the light emitting device comprises a light emitting diode mounted on a printed circuit board.

15. A lighted switch according to claim 14, wherein the printed circuit board comprises electrically conductive switch contact paths on one face and electrically conductive paths on another face in electrical contact with the light emitting diode.

16. A lighted switch according to claim 11, further comprising:

means for translating a plunging motion of the plunger to a rotation of the electrically conductive member, wherein the rotation axis is substantially the same as an axis of the light pipe.

17. A lighted switch according to claim 16, wherein the electrically conductive paths are on a top face of a printed circuit board, and wherein the lighted switch further comprises electrically conductive paths on a bottom face of the printed circuit board in electrical contact with the light emitting device.

18. A lighted switch according to claim 17, further comprising a tab on the printed circuit board, and a recess in the switch body fitting around the tab.

* * * * *